United States Patent [19]

Harcuba

[11] 3,990,240

[45] Nov. 9, 1976

[54] CONTROL METHOD AND APPARATUS FOR PROCESSING TOOLS

[76] Inventor: Siegfried Harcúba, Petersbergstr. 51, Saarbrücken, Germany

[22] Filed: June 12, 1975

[21] Appl. No.: 586,391

[30] Foreign Application Priority Data

June 13, 1974 Switzerland ..... 8109/74

[52] U.S. Cl. ..... 60/533; 60/540; 92/12; 92/134

[51] Int. Cl.[2] ..... F15B 7/00

[58] Field of Search ..... 60/327, 328, 329, 533, 60/540, 545, 414; 91/4, 5, 35, 48, 420; 92/11, 12, 13, 134

[56] References Cited

UNITED STATES PATENTS

| | | | |
|---|---|---|---|
| 706,688 | 8/1902 | Reynders et al. | 91/4 X |
| 2,716,395 | 8/1955 | Pettigrew et al. | 60/540 |
| 2,733,691 | 2/1956 | Johnson | 60/540 |
| 2,852,965 | 9/1958 | Wallace | 60/533 X |

*Primary Examiner*—Edgar W. Geoghegan
*Attorney, Agent, or Firm*—Oblon, Fisher, Spivak, McClelland & Maier

[57] ABSTRACT

A method of controlling the advance and retraction of a tool on a processing machine in dependence of mechanical properties of the workpiece which tool communicates hydraulically on one hand with a drive means and on the other hand via a shut-off member on by-passes, with a pressure converter, the closing or opening of the shut-off member taking place through electrical pulses of a pressure measuring element, the pressure produced during the flow of the pressure fluid through an adjusting valve being kept constant, increasing, or decreasing for respective time periods each, the setting of the adjusting valve being operated by a pressure control for producing constant increasing, or decreasing pressure, and the pressure produced by the pressure converter and causing the retraction of the tool starting immediately after completion of its advance and being kept uniform, and an apparatus for carrying out the method.

5 Claims, 2 Drawing Figures

CONTROL METHOD AND APPARATUS FOR PROCESSING TOOLS

Figure 1:
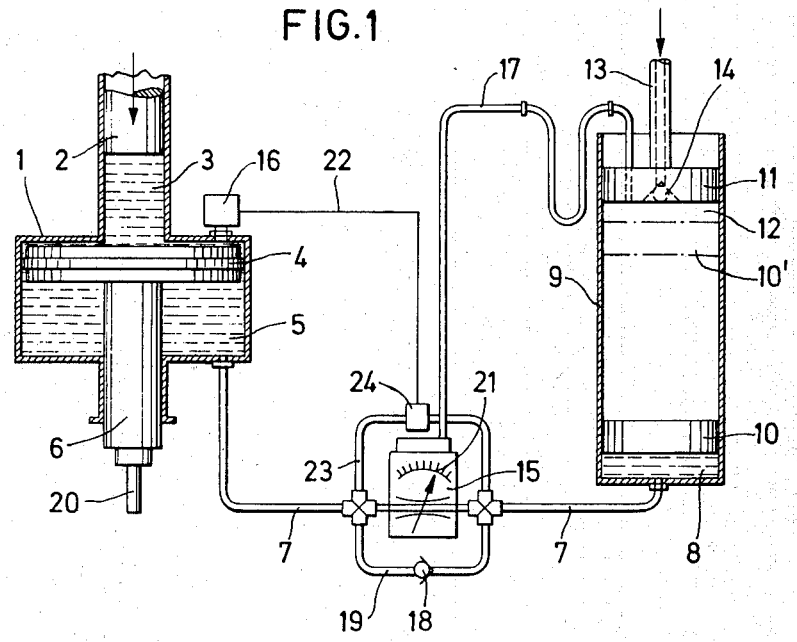

This invention relates to a method for controlling the advance and retraction of a tool on a processing machine, which tool is secured to one end of a piston rod, the other end of which is provided with a working piston, one face of which communicates hydraulically with a drive means, and the other face of which, facing the tool, communicates hydraulically with a pressure converter, the pressure fluid pressed out of the cylinder during the advance of the tool flowing unthrottled through a shut-off member until a hydraulic pressure begins to build up in the cylinder after the tool has come in contact with the work-piece, by means of which pressure the shut-off member is closed via a measuring element measuring the pressure, so that the pressure fluid is then compelled to flow through an adjusting valve and exerts pressure upon the piston. The invention further relates to an apparatus for carrying out the foregoing method, comprising an adjustable control element connected to a fluid-line connecting the lower chamber of the working cylinder to the lower chamber of the pressure converter, a shut-off member disposed in a first by-pass, and a check valve disposed in a second by-pass.

A number of serious disadvantages are known to occur in connection with, e.g., punching presses when their mechanical compressive force is produced pneumatically, hydraulically, pneumatohydraulically or electromechanically. This will be described below by means of an example.

A steel workpiece section, 20 mm. thick, for example, is to be punched. During the build-up of pressure, e.g., pneumatic pressure, the tool will gradually come to rest against the surface of the workpiece and remain there until the tool pressure is capable of overcoming the resistance or shear force of the material, whereupon the cutting operation commences. The tool penetrates into the workpiece, whereby the portion to be punched out is pressed out. While this cutting operation is taking place, the magnitude of resistance in the workpiece decreases very quickly and drops to zero as soon as the punched-out portion leaves the punch hole, i.e., during the pressing-out process. However, since the thrust of the tool (mechanical compressive force) remains constant, this leads to a rapid acceleration of the tool and to tearing the punched-out portion of the workpiece. This is the source of the roughness of the surfaces and exit edges of the punched-out portion, structural distortions, bucklings, and inadmissible residual stresses around the edges of the hole.

In order to avoid these disadvantages, recourse has heretofore been made to counterpunch devices, such as hydraulically-driven mechanical counterpunches (ejectors) which act upon the portion to be punched out (cf. German Pat. No. 1,805,984). Such devices are susceptible to trouble, take up additional space, and nevertheless, according to experience, leave additional surface stresses and bucklings, which becomes particularly disadvantageous upon reversal of the direction of movement within the die.

The arrangement of separate hydraulic-mechanical counterpunch devices makes the installation of a press more difficult and prolongs the time for changing implements for each new production series. Inaccurate setting of such counterpunch devices can lead to destruction of the tools and make the desired fabrication impossible.

As has become known from a German technical journal, a throttle valve has been provided between the plunger and the working cylinder for eliminating the transfer of the non-uniform pressure build-up in the pneumatic cylinder to the hydraulic cylinder in a pneumatohydraulic drive. This arrangement, too, has the aforementioned inherent disadvantages that the tool control cannot be adapted to the behavior of the material and that no retraction of the tool is carried out.

It is the object of this invention to eliminate the shortcomings described above.

To this end, in the method according to the present invention, the closing of the shut-off member takes place through electrical pulses of the measuring element, the pressure produced during the flow of the pressure fluid through the adjusting valve acts upon the face of the piston facing the tool and is kept constant, increasing, or decreasing for respective periods each, the setting of the adjusting valve is operated by a pressure control for producing constant, increasing, or decreasing pressure, and the pressure produced by the pressure converter and causing the retraction of the tool, after the initial maximum value for accelerating the start of the retraction, remains uniform and acts directly upon the working piston, by passing the control element, the retraction of the tool being initiated and carried out by this pressure immediately after completion of its advance.

As a result, the tool is not rapidly accelerated at the moment when the resistance or shear strength of the material is overcome, but owing to the pressure determined by the control element and acting upon the working piston during its cutting operation, the tool continues to work evenly and produces clean cut or shaped surfaces. By means of a one-time setting of the control element for a given workpiece, an automatic adaptation of the speed of the tool to the particular characteristics of the workpiece is ensured for each follow-up stroke.

In the apparatus according to the present invention for carrying out the foregoing method, the control element communicates controllably via a comm-pressed-air line with the upper portion of the pressure converter or via an oil-pressure line with the lower portion of the pressure converter or with the supply line thereto, and the shut-off member is operable by electrical pulses of a measuring element connected to the upper chamber of the cylinder and responsive to the pressure in this upper chamber.

Figure 2:
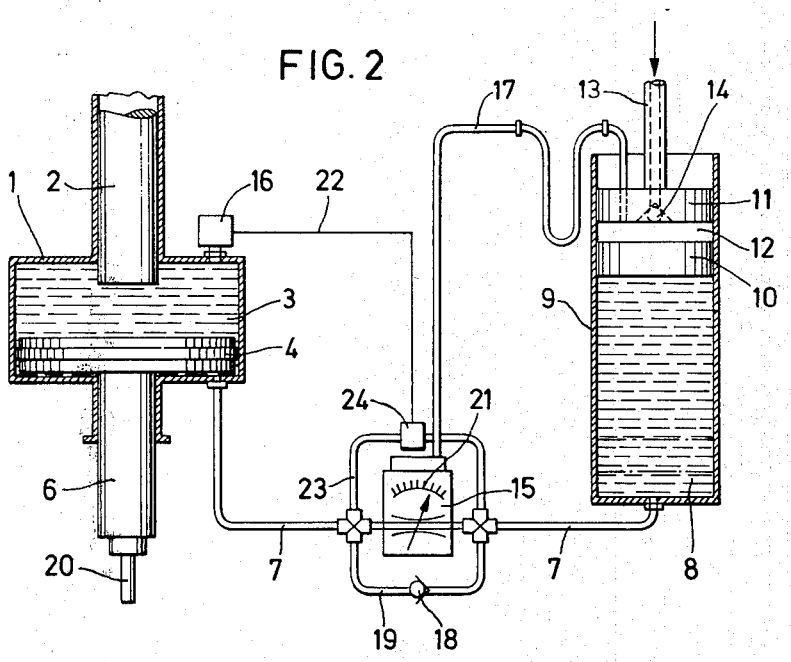

In order to illustrate the method of the invention more clearly, a preferred embodiment of the control apparatus for carrying it out will now be described in detail with reference to the accompanying drawing, in which:

FIG. 1 is a diagrammatic view of a control apparatus on a punching press for carrying out the method of the invention, showing the tool in the starting phase of the working stroke, and FIG. 2 is a diagrammatic view of the same control apparatus showing the tool in the end phase of the working stroke.

In the diagrammatic views of FIGS. 1 and 2, the functional relationship and the mode of operation of the individual elements is clearly illustrated in a simplified manner. Pneumatic pressure is converted into hydraulic pressure in a drive means (not shown) having an indicated plunger 2. This converted pressure acts upon a working piston 4 which is slidingly disposed in a working cylinder 1 having an upper chamber 3 and a lower chamber 5. A cutting tool 20, for example, is secured to the end of a piston rod 6 opposite from the working piston 4. When the working piston 4 moves downwards, a liquid such as glycerin, hydraulic oil, or water, contained in the cylinder 1 in the lower chamber 5 thereof at the face of the working piston 4 facing the tool 20, is pressed out of the cylinder 1 through a pipe 7.

The working stroke of the working piston 4 may be broken down into a rapid-advance motion, i.e., the initial path of the tool 20 up to a workpiece (not shown), and a cutting operation, i.e., the punching of the desired portion out of the workpiece by the tool 20.

In order not to delay the rapid-advance motion of the tool 20 towards the workpiece, the liquid flows unthrottled in a normal way through a shut-off member 24 disposed in a by-pass 23.

As soon as the hydraulic pressure has built up in the upper chamber 3, i.e., when the tool 20 is resting on the workpiece, the tool 20 overcomes the shear strength of the workpiece by means of the pressure acting upon the tool 20, which then begins to punch. In order to prevent considerable driving forces from being released as a result of the constant pneumatohydraulically-acting compression force while the resistance of the material is rapidly decreasing, whereby a swift acceleration of the punching tool commences and the punched portion is torn out of the workpiece, the speed of the working piston 4 and of the tool 20 integral therewith is now forcibly controlled by the mode of opening, predetermined for the properties of the workpiece (i.e., hardness of material, thickness of material, ductility, etc.), of an adjusting valve 15 disposed in the pipe 7 and having a measurement scale 21.

The hydraulic pressure built up in the upper chamber 3 of the working cylinder 1 is, in fact, registered by a pressure-sensitive measuring element 16 connected to the upper chamber 3. The electrical pulses from the measuring element 16 are transmitted via a line 22 to the shut-off member 24 in such a way that when a pressure value pre-set on the measuring element 16 is reached, the shut-off member 24 closes, so that the liquid necessarily flows through the adjusting valve 15. The pressure value at which the measuring element 16 transmits pulses is set as a function of the resistance of the material of which the workpiece to be processed is made. A very slight delay, on the order of a fraction of a second, occurs as result of the electrical pulses of the measuring element 16.

For a certain period of time each, a constant pressure or, as will be explained further on, an increasing or a decreasing pressure acts upon the face of the working piston 4 facing the tool 20, so that the punching speed of the tool 20 does not increase towards the end of the punching operation, and the retraction of the tool 20 is started and carried out immediately after its advance has been completed.

Adjustable throttle valves of a known kind (flow-control valves) are preferred as adjusting valves. However, a displacement-type pump, such as a gear pump, will also be suitable. Controls in fractions of a unit of time are made possible by the setting of the valve 15 controlling the flow. This purpose is served through the scale 21, on which, for example, a third, a fourth, etc., of the indicated degree can be set up. The operative range of the throttling is visible and adjustable on the scale 21.

The pipe 7 for the liquid connects the lower chamber 5 of the working cylinder 1 to a lower portion 8 of a pressure cylinder 9, in which a piston 10 is freely slidable between two end positions. The other end of the pressure cylinder 9 is closed off by an adjustable and lockable piston 11. The space between the freely slidable piston 10 and the lockable piston 11 serves for the building up of a gas tension and is operatively divided into a portion of space defined in its utmost positions by the lower and the upper end positions 10' of the freely slidable piston 10, and a remaining upper portion 12 which is variable in size by the position in which the piston 11 is locked. The upper end position 10' is to be disposed with a large tolerance or without limitation in order to preclude undesirable pressures on gaskets and the like when there is a slight excess in the amount of liquid during refilling or adding liquid. The means for adjusting and locking the piston 11 and the means for necessarily securing it against the piston pressure are not shown. A piston rod 13 of the piston 11 takes the form of a tube through which compressed air is supplied to the interior of the cylinder 9 through a check valve 14. The piston 10 freely slidable in the pressure cylinder 9 is pressed into its upper end position as a result of the displacement of the liquid from the working cylinder 1 into the pressure cylinder 9, a greater or lesser gas tension being built up according to the remaining upper portion 12 determined by the setting of the piston 11.

After the punch has been cleanly carried out, the working piston 4 is at its bottom dead center, as shown in FIG. 2, whereby the major portion of the liquid has been pressed out of the lower chamber of the working cylinder 1 through the pipe 7 into the compression-resistant cylinder 9. In this position, the working piston 4 is relieved of the force of the plunger.

The return of the tool to its starting position and the separation of the tool from the workpiece have been effected until now in the case of pneumatohydraulic drives by removing the pneumatic working pressure and by introducing a pneumatic counter-pressure both in the pneumatic drive means and in the part of the cylinder bore adjacent to the face of the working piston facing the tool. As a result of the necessary build-up of pressure, this entails a loss of time between the individual working strokes of the tool, meaning that only a low stroke output per minute is made possible, so that the field of application of such presses or apparatus is very greatly narrowed because of the economic disadvantages.

In the case of pneumatohydraulic drives, the plunger accompanies the pneumatically-impinged piston on its return. If, however, the tool does not disengage from the workpiece, the working piston also comes to a halt. Between the plunger and the working piston a vacuum is produced into which air penetrates and thus renders the hydraulic system incapable of operation.

These disadvantages are done away with, since even before the start of the retraction operation of the tool 20, a pneumatic tension is created in the pressure cylinder 9 which acts upon the liquid displaced into the cylinder 9. The tension built up in the upper portion 12 acts via the freely slidable piston 10 upon the liquid, which is conveyed through the pipe 7, through a check valve 18 disposed in a by-pass 19, and again through the pipe 7 into the lower chamber 5 of the cylinder 1, where the liquid pressure acts upon the working piston 4 immmediately after the completed working stroke of the tool 20 and thus initiates and carries out the rapid-return motion of the tool 20 attached to the working piston 4. The rapidity of this return is determined by the magnitude of the gas tension; the high pressure of the liquid at the beginning hastens the start of the retraction, after which the high pressure changes into a constant, lower pressure corresponding to the basic gas tension. During the retraction of the tool 20, the adjusting valve 15 remains closed for the liquid conveyed from the pressure cylinder 9 to the working cylinder 1.

The adjusting valve 15 is operated by a compressed-air control (not shown) via a compressed-air line 17, or by a pressure-oil control (not shown) via a pressure-oil line. The control pressure in the line 17 is withdrawn from the upper portion 12 of the pressure cylinder 9; the control oil-pressure is withdrawn from the lower chamber 8 or its supply pipe 7.

In further sequence, all pneumatohydraulic drive elements of the drive means (not shown) are also set in motion in the same direction. Based upon this pressure effect, the rapid-return motion of the tool 20 can be carried out extremely quickly and without any loss of time immediately after the completion of the working stroke of the tool 20.

The drive producing the pressure in the working cylinder may also take place electromechanically, using known devices for protecting against a sudden drop in the output of the motor. The functions of the individual operations may be controlled electrically or electronically in a known manner. No detailed explanations need be given owing to the commercially available possibilities.

The solution according to the invention combines a number of technical advanges. The controlled course of working operations of the piston carrying the tool results in a cleanly-punched surface within narrow tolerances or in a shaping to accurate dimensions.

In the case of a pump-type hydraulic system acting upon a working-piston cylinder having a long piston path, the controllability of the aforementioned gas tension enables a continuously variable bridging of the interruptions of conveyance at the dead-center positions and eliminates leakage losses as well as the danger of a too-low gas pressure when known expansion chambers are used.

A further advantage resides in the possibility of variable control of a piston movement running as slowly as may be desired, for in the case of processing materials which are resiliently deformed under pressure, it is well known that the shear strength is not a material constant but depends, among other things, on the speed of processing; hence in the case of tool-carrying pistons, on the course of movement in terms of time.

The advantage in the rapid-return motion of the tool is attributable to the fact that even before the start of the retraction, or simultaneously with it at the latest, a pressure produced by the gas tension is present and can be utilized, which pressure sets the working piston in motion immediately after the completion of the working stroke and separates the tool from the workpiece.

In the case of a hydropneumatic drive, a further advantage resides in the fact that the volume of the hydraulic working cylinder to be filled up is substantially smaller than that of the inverse-ratio pneumatic piston-cylinder. This results in an optimum number of strokes per minute.

Tests with the apparatus described above have yielded expectedly good results. By means of the above-described method and the above-described apparatus for carrying it out, the disadvantages of the known inhibition of acceleration of the working piston, which is dependent upon the build-up of pressure, are avoided. The method described above opens up great new fields of application for pneumatic drives, and above all for pneumatohydraulic drives. The progress that an explosion-like relaxation of the pneumatic pressure need no longer take place, combined with the progress of a speedier mode of operation through higher stroke rates per minute, unite new, advantageous economic and technical effects.

What is claimed is:

1. A method for controlling the advance and retraction of a tool on a processing machine for performing a punching operation on a workpiece, which tool is secured to one end of a piston rod, the other end of which is provided with a working piston, movably disposed in a cylinder, one face of which communicates hydraulically with a drive means, and the other face of which, facing the tool, communicates hydraulically with a pressure converter, the pressure fluid passed out of the cylinder during the advance of the tool flowing unthrottled through a shut-off member until a hydraulic pressure begins to build up in the cylinder after the tool has come in contact with the workpiece, by means of which pressure the shut-off member is closed via a measuring element measuring the pressure, so that the pressure fluid is then compelled to flow through an adjusting valve and exerts pressure upon the piston, wherein the closing of the shut-off member takes place through electrical pulses of the measuring element, the pressure produced during the flow of the pressure fluid through the adjusting valve acts upon the face of the piston facing the tool and is kept constant, increasing, or decreasing for respective periods each, the setting of the adjusting valve being operated by a pressure control for producing constant, increasing, or decreasing pressure, and the pressure produced by the pressure converter and causing the retraction of the tool, after the initial maximum value for accelerating the start of the retraction, remains uniform and acts directly upon the working piston, bypassing the control element, the retraction of the tool being initiated and carried out by this pressure immediately after completion of its advance.

2. An apparatus for carrying out the method of claim 1, comprising an adjustable control element connected to a fluid-line connecting the lower chamber of the working cylinder to the lower portion of the pressure converter, a shut-off member disposed in a first by-pass, and a check valve disposed in a second by-pass, wherein the control element communicates controllably via a compressed-air line with the upper portion of the pressure converter and via an oil-pressure supply line with the lower portion of the pressure converter, and the shut-off member is operable by electrical pulses of the measuring element connected to the upper chamber of the cylinder and responsive to the pressure in said upper chamber.

3. An apparatus in accordance with claim 2, wherein the control element is an adjusting valve changing the sectional area of the fluid-line and having a measurement scale, through which adjusting valve the fluid flows only during the punching operation of the tool.

4. An apparatus in accordance with claim 2, wherein the pressure-sensitive measuring element controls a shut-off member by electrical pulses, its pressure value causing the transmission of pulses being adjustable according to the resistance value of the material to be processed.

5. An apparatus in accordance with claim 2, wherein the volume of the upper portion of the pressure converter is variable by means of an axially adjustable piston.

* * * * *

UNITED STATES PATENT AND TRADEMARK OFFICE

CERTIFICATE OF CORRECTION

PATENT NO. : 3,990,240

DATED : November 9, 1976

INVENTOR(S) : Siegfried Harcuba

It is certified that error appears in the above-identified patent and that said Letters Patent are hereby corrected as shown below:

[30] Foreign Application Priority Data

Please delete "8109/74 Switzerland June 13, 1974" and insert therefor --8109/74 Switzerland July 3, 1974--.

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*